US007819492B2

(12) United States Patent
Watanabe et al.

(10) Patent No.: US 7,819,492 B2
(45) Date of Patent: Oct. 26, 2010

(54) IMAGE PROCESSING APPARATUS, IMAGE PROCESSING METHOD AND COMPUTER-READABLE RECORDING MEDIUM OF IMAGE PROCESSING METHOD

(75) Inventors: Jun Watanabe, Tokyo (JP); Yuji Ieiri, Kanagawa (JP); Kohichi Sadano, Kanagawa (JP); Tsuyoshi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 12/176,545

(22) Filed: Jul. 21, 2008

(65) Prior Publication Data

US 2009/0027432 A1 Jan. 29, 2009

(30) Foreign Application Priority Data

Jul. 27, 2007 (JP) ..... 2007-196253

(51) Int. Cl.
*B41J 29/38* (2006.01)

(52) U.S. Cl. ..... 347/11; 347/10; 347/5

(58) Field of Classification Search ..... 347/5, 347/9, 10, 11, 12, 14–15
See application file for complete search history.

(56) References Cited

U.S. PATENT DOCUMENTS 6,257,689 B1 * 7/2001 Yonekubo ..... 347/11
6,494,556 B1 * 12/2002 Sayama et al. ..... 347/11

FOREIGN PATENT DOCUMENTS

JP 2005-169737 6/2005
JP 2006-264287 10/2006

* cited by examiner

*Primary Examiner*—Lam S Nguyen
(74) *Attorney, Agent, or Firm*—IPUSA, PLLC

(57) ABSTRACT

An image forming apparatus includes an image process control unit processing an image data and generating a control signal, and a drive pattern generation unit to generate a drive pattern to drive a recording head, based on the control signal, the drive pattern generation unit generating at least a first drive pattern and a second drive pattern which is different from the first drive pattern. The drive pattern generation unit sets a reference potential of the second drive pattern as a target reference potential and applying a pattern end of the first drive pattern to one of a pull-up pattern and a pull-down pattern operation before the second drive pattern is performed, wherein the drive pattern generation unit generates one of the pull-up pattern and the pull-down pattern based on a slope value obtained by comparing the target reference potential and the end potential.

11 Claims, 13 Drawing Sheets

IMAGE PROCESSING APPARATUS, IMAGE PROCESSING METHOD AND COMPUTER-READABLE RECORDING MEDIUM OF IMAGE PROCESSING METHOD

BACKGROUND OF THE INVENTION

1. Field of the Invention

The present invention is related to an image forming method that forms an image by jetting ink from a recording head and an information forming apparatus using the image forming method.

2. Description of the Related Art

Conventionally, it is known that an inkjet type image forming apparatus having a carriage mounted with a recording head scans in a main scanning direction and jets ink drops for forming an image on a recording medium moving in a sub-scanning direction.

Such an image forming apparatus includes plural kinds of driving patterns such as "a print driving" for jetting ink drops, "an ink purge driving" for cleaning nozzles to recover from clogging caused by a long-time unused condition, and "minor driving" for maintaining nozzles to prevent clogging.

Further, the image forming apparatus needs to output a drive pattern (drive waveform) for driving the recording head. There are several proposed techniques for outputting such a drive pattern.

As a drive pattern, there is known a technique of "pull-up/pull-down" that controls electric potential (potential) to be a predetermined electric potential according to requirements for a recording head, in which a "pull-up" pulls up potential from zero to a reference potential and "pull-down" pulls down the potential to zero potential after the drive pattern is output.

However, for conventional pull-up/pull-down operations, when it is required to continuously execute different kinds of recording head driving operations, a pull-down operation is required to once pull down the potential to zero after the driving of the head being executed at a predetermined time is completed. Thereafter, a pull-up operation is required to pull up the potential to a reference potential depending on the kind of the recording head driving operation. For this reason, it was difficult to promptly cope with the need to pull down and pull up the potential of the drive waveform.

Further, as a different issue, extra electric power is necessary because the pull-up operation raises potential from zero potential and the pull-down operation drops potential to zero potential every time when another recording head driving operation is requested.

In order to improve the efficiency of recording head driving for a conventional case, a technique is shown where the environment temperature is preliminarily measured and the drive pattern is adjusted in a potential direction and a time base direction (see Japanese Patent Application Publication 2006-264287). This technique provides an optimum driving potential to be selected according to each driving condition.

However, the above technique does not take into consideration a recording head which outputs a different kind of drive pattern by switching to another waveform pattern (drive pattern) immediately after an output of a certain kind of drive pattern (waveform pattern), and there is an issue remaining for immediate switching of an output waveform pattern and reducing power consumption.

SUMMARY OF THE INVENTION

One aspect of the present invention may provide highly efficient driving of and low power consumption by a recording head of an image forming apparatus that forms images by jetting ink drops by immediately switching the driving status of the recording head when plural kinds of driving modes are available.

According to one aspect of the present invention, an image forming apparatus may include an image process control unit processing an image data and generating a control signal and a drive pattern generation unit to generate a drive pattern to drive a recording head, based on the control signal; the drive pattern generation unit generating at least a first drive pattern and a second drive pattern which is different from the first drive pattern; the drive pattern generation unit setting a reference potential of the second drive pattern as a target reference potential and applying a pattern end of the first drive pattern to one of a pull-up pattern and a pull-down pattern operation before the second drive pattern is performed, wherein the drive pattern generation unit generates one of the pull-up pattern and the pull-down pattern based on a slope value obtained by comparing the target reference potential and the end potential.

According to another aspect of the present invention, an image forming method may include the steps of: (a) processing an input image to generate a control signal; (b) generating at least a first drive pattern and a second drive pattern which is different from the first drive pattern to drive a recording head in response to the control signal; (c) setting a reference potential of the second drive pattern as a target reference potential; and (d) performing pull-up or pull-down operation from a potential at a predetermined time after a pattern end of the first drive pattern to pull up or pull down the potential to the target reference potential according to a slope value; wherein the slope value is determined by comparing the potential and the target reference potential.

According to one aspect of the present invention, for an image forming apparatus forming images by jetting ink, fast image formation is possible by immediately switching plural driving modes with lower power consumption.

Other objects, features and advantages of the present invention will become more apparent from the following detailed description when read in conjunction with the accompanying drawings.

DETAILED DESCRIPTION OF THE PREFERRED EMBODIMENTS

An image forming apparatus and an image forming method in embodiments of the present invention are described in the following with accompanying figures. The present invention is not limited to the following embodiments and may be applied to any apparatus including a recording head driven by a drive pattern and forming images by jetting ink drops.

Figure 1:
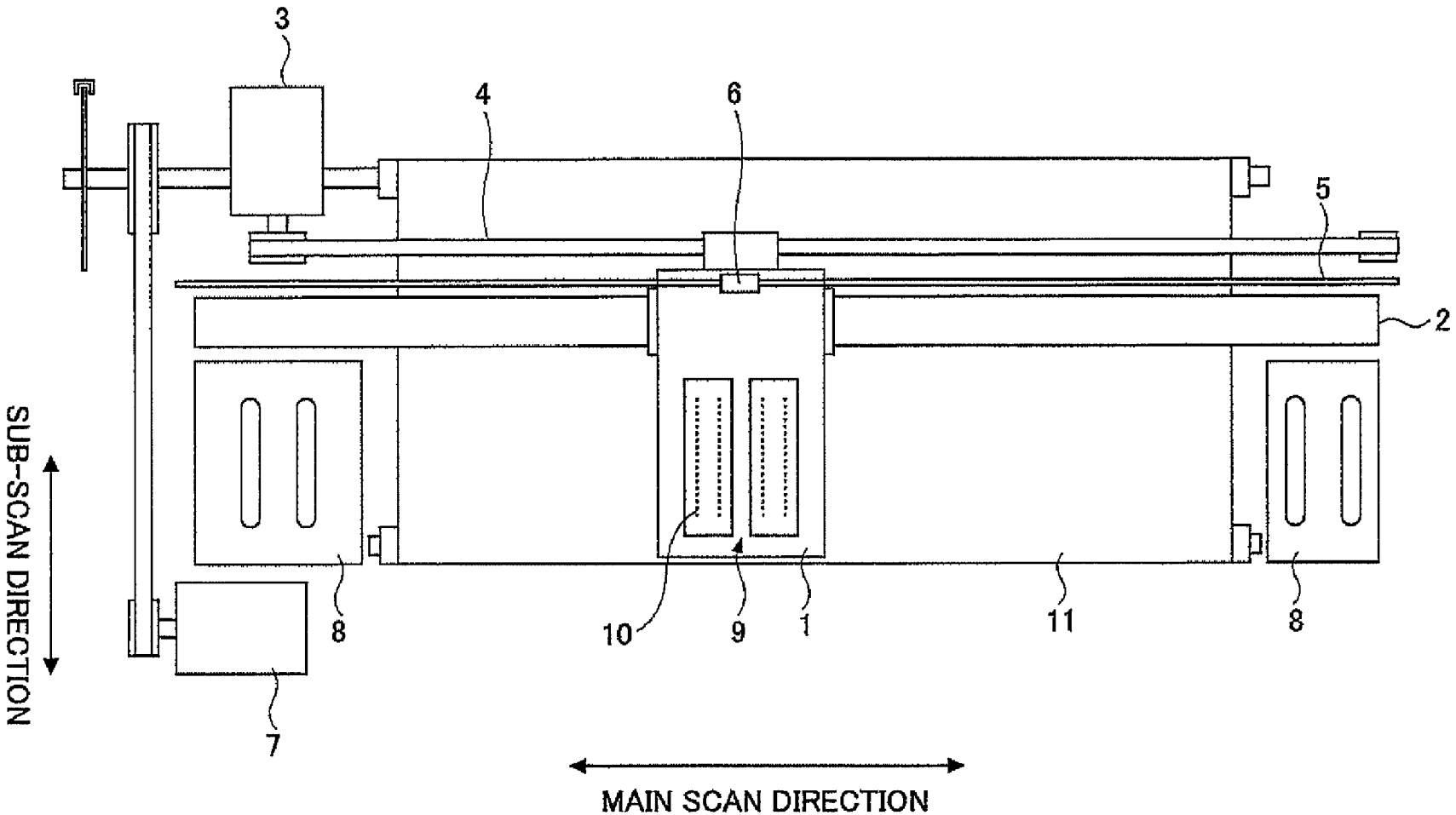
FIG. 1 shows an illustration of an inkjet recording apparatus (an image forming apparatus) in an embodiment of the present invention.

As an example of an image forming apparatus in an embodiment of the present invention, FIG. 1 shows a simplified configuration of an inkjet recording apparatus.

Figure 2:
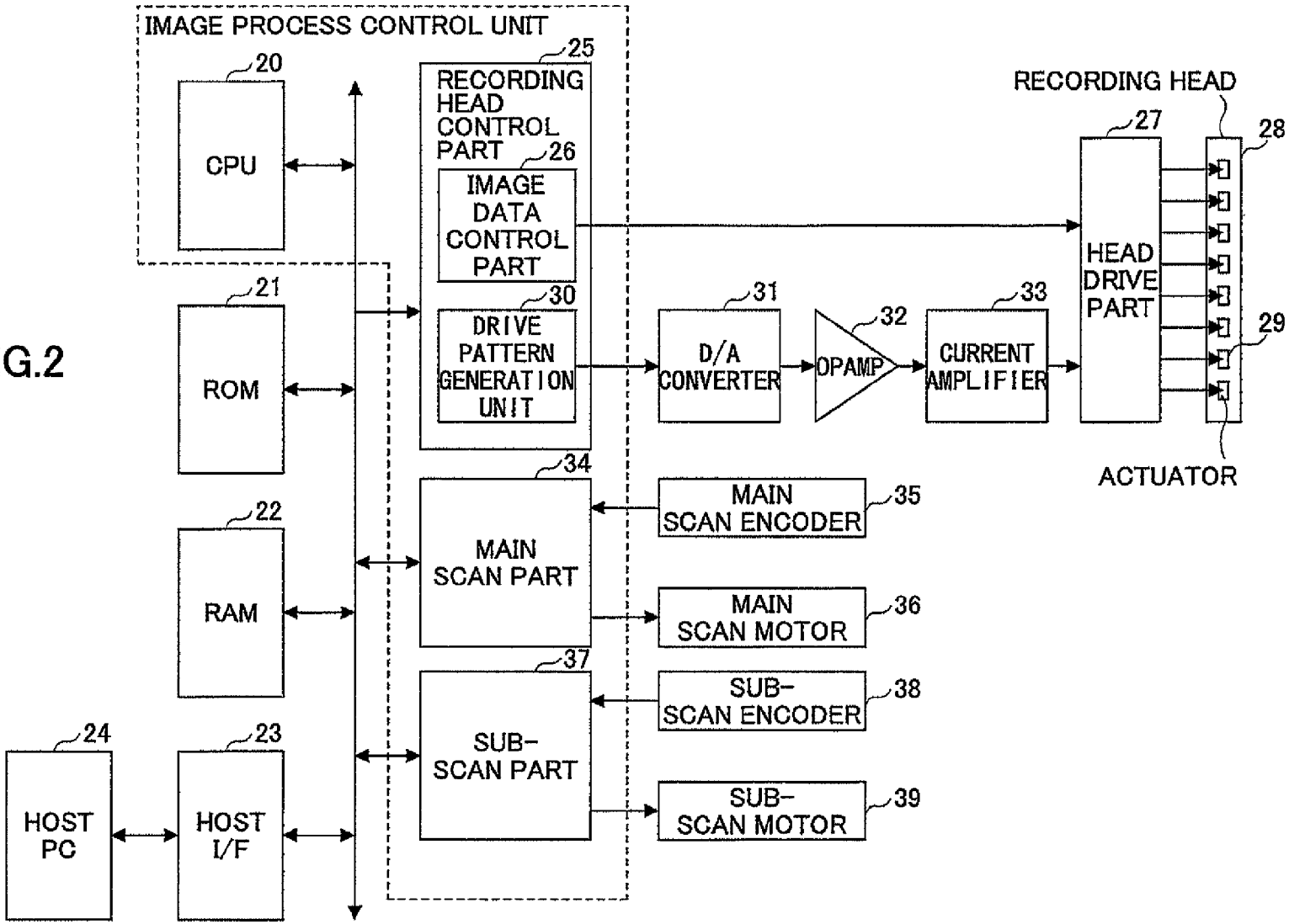
FIG. 2 shows a block diagram of an inkjet recording apparatus.

The inkjet recording apparatus includes an image process control unit (or image processing unit) which generates image data from an input image received from an external device such as a host computer 24 for downloading an image. The inkjet recording apparatus performs an image formation (i.e. forms images) according to the image data output from the image process control unit. The image process control unit may include a CPU 20 and the like, as shown in FIG. 2. The image process control unit of this embodiment includes at least a CPU, a recording head control part having at least an image data control part and a drive pattern generation unit, a main scan part, and a sub-scan part, as indicated by a dashed line in FIG. 2.

Figure 3:
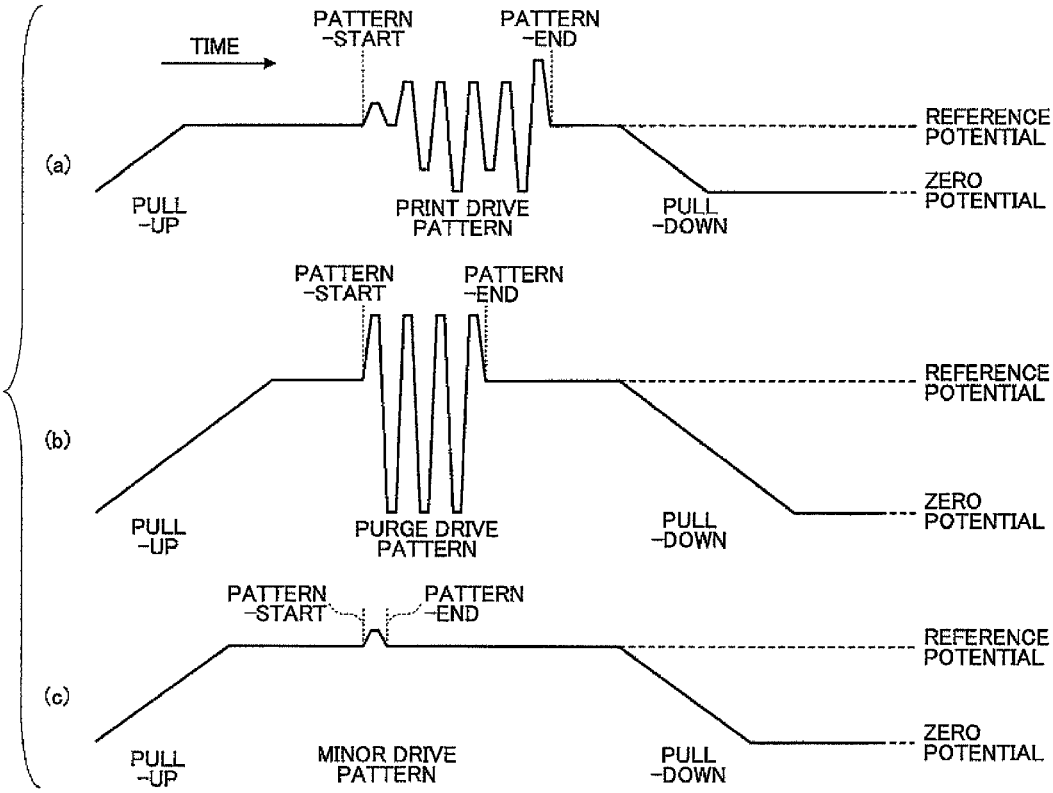
FIG. 3 shows drive patterns (a), (b) and (c) including individual printing waveforms (drive patterns), purging waveforms, and minor driving waveforms.

The inkjet recording apparatus has a carriage 1, having an ink nozzle for jetting ink drops, to scan a recording medium (recording paper) 11 a main scanning direction while transporting the recording medium 11 in a sub-scanning direction according to a signal from the image process control unit. A recording head 9 is driven according to a drive pattern generated by a drive pattern generation unit (drive waveform pattern generation unit). The drive pattern generation unit includes a pull-up/pull-down function (operation). The pull-up/pull-down function outputs a second drive pattern after a first drive pattern which is one of plural kinds of drive patterns. The potential of the second drive pattern is set as a target reference potential. The pull-up/pull-down function generates a drive pattern to perform a pull-up or a pull-down operation for application to an end potential of the first drive pattern at the end of a predetermined time interval, in which the drive pattern is generated according to a slope value obtained by a comparison between the target reference potential and the end potential. For example, the drive pattern ends at the point (a pattern end) where pull-down operation starts, as shown in FIG. 3.

The carriage 1 is guided by a guide rod 2 horizontally connected on sideboards at left and right (not shown) sides, and is configured to scan in the main scanning direction driven with a timing belt 4 that is supported by pulleys using a main scanning motor 3.

For example, on the carriage 1 is mounted a recording head part 9 that includes four inkjet heads, and the four inkjet heads jet yellow (Y), cyan (C), magenta (M), and black (B) ink, respectively. A nozzle array 10 formed by plural ink nozzles is arranged in the recording head 9 in a direction (sub-scanning direction) perpendicular to the main scanning direction.

The recording head 9 may have a known structure which includes a pressure generating unit, for example, a piezoelectric actuator made of a piezoelectric element or the like, a thermal actuator including an electrothermal converter element such as a heating resistor or the like applying a phase change in a liquid by film boiling, a shape memory alloy actuator applying metallic phase change by a temperature variation, and an electrostatic actuator applying electrostatic force generating a pressure for jetting a liquid droplet.

The carriage 1 includes an encoder scale 5 having slits with equidistant patterns arranged along the main scanning direction. Furthers the carriage 1 includes an encoder sensor 6 for sensing the slits of the encoder scale 5. The encoder scale 5 and the encoder sensor 6 form a linear encoder to detect a position of the carriage 1 in the main scanning direction.

Position information of the carriage 5 may be obtained by reading the slits recorded in the encoder 5 and adding or subtracting the count while scanning.

For the inkjet recording apparatus, the recording medium is transported to a transport belt while being attracted by an electrostatic attraction at a position facing the recording head 9.

A seamless belt may be used for the transport belt to transport the recording medium. The transport belt is supported between a transport roller and a tension roller and is transported in a belt transport direction (sub-scanning direction in FIG. 1). The transport belt is charged by a charging roller while circulating.

The transport belt for the recording medium may have a single layer structure or a multi-layer structure.

When the single layer structure is used for the transport belt, the layer is formed of the insulating material, as the transport belt contacts the recording medium and the charging roller.

When the multi-layer structure is used for the transport belt, it is preferable that the layer of the transport belt contacting the recording medium and the charging roller is made of an insulating material and the other layer not contacting the recording medium and the charging roller is made of a conductive material.

As a first scanning operation, the carriage 1 scans once in the main scanning direction (main-scan direction) with ink jet operations and an image is formed with a band width (a unit width) equal to the length of a nozzle array taken along the sub-scanning direction. After the image with the unit width is formed, as a second scanning operation, the sub-scanning motor 7 is driven to transport the recording medium 11 in the sub-scanning direction (sub-scan direction), and another first scanning operation is performed. The first and second scanning operations are alternately repeated in this manner, so that a predetermined image is formed in the main and sub-scanning directions on the recording medium 11.

Next functions of the image forming apparatus (inkjet recording apparatus) in this embodiment according to the present invention is described by using FIG. 2.

In the inkjet recording apparatus of the present embodiment, it may be regarded that a RON of FIG. 2 stores firmware for controlling hardware of a printer part and data of drive waveform patterns (drive patterns) for driving the inkjet recording head (recording head) 9.

In this inkjet recording apparatus, the image process control unit (CPU 20) sends predetermined image data when a print job (image data) is received.

More specifically, individual functions constituting the image process control unit are described.

A CPU 20 reads data of an appropriate drive pattern data fitting the environment of a printer (an inkjet recording apparatus) from the ROM 21 and temporarily stores the data in a drive pattern generation unit 30.

Further, the characteristics of a recording head itself and the temperature dependence of ink relate to the environment of a recording head.

As the jetting ink characteristics of nozzles fluctuate between recording heads at the time of manufacture, the individual recording heads are adjusted for each drive pattern to properly jet ink of a predetermined amount.

The viscosity of ink decreases as the environmental temperature increases, so that the amount of inkjet increases for an identical drive pattern. Further, as the viscosity of ink increases as the environmental temperature decreases, the amount of ink jetted decreases for the identical drive pattern. Therefore, the environmental temperature is measured by a temperature sensor mounted on the image processing apparatus and the drive pattern is controlled by taking the temperature into account.

Therefore, the drive pattern generation unit 30 determines a slope of the pull-up pattern or the pull-down pattern to be applied to the drive pattern according to the driving environment of the recording head to reduce the fluctuation of the characteristics of the individual recording heads and the temperature dependence on the viscosity of ink for individual drive patterns.

Next, the recording head 9 is moved to a predetermined position above the recording medium 11 by using the main scan control part 34 and a sub-scan control part 37. Next, actuators 29 are driven by utilizing an image data control part 26 of a recording head control part 25 and the drive pattern generation unit 30 and a head drive part 27 for jetting ink droplets.

For a drive pattern for driving the individual functions, a digital signal output by the drive pattern generation unit 30 is converted into an analog signal and sent to the actuator 29 through a digital-to-analog (D/A) converter 31, a voltage amplifier 32 (OPAMP), and a current amplifier 33.

For inkjet operations, voltage control according to a control signal is described.

Further, the nozzles for ink jetting are provided with the actuators 29 for jetting ink, and the actuators 29 are provided with piezoelectric elements.

The piezoelectric element changes its volume by applying voltage and is required to be applied potential pattern (voltage pattern) called a drive pattern (drive waveform pattern) so that an ink droplet is jetted out according to a predetermined droplet size and a jetting rate.

Next, the drive patterns are described by referring to FIG. 3(*a*)-(*c*), where a vertical direction indicates a potential (voltage) and a horizontal direction indicates time.

The drive patterns include three kinds, namely (a) a print drive pattern to jet ink droplets onto a recording medium for forming an image;

(b) a purge drive pattern to purge ink droplets onto a maintenance unit located outside of a recording area; and (c) a minor drive pattern for driving actuators to jet no ink droplet to prevent ink at the nozzles from drying.

The three drive patterns have different reference potentials and drive patterns.

The print drive pattern starts and ends at the reference potential for this print drive pattern respectively indicated by "pattern-start" and "pattern-end" in FIG. 3(*a*). Between the start and the end of the print drive pattern, the recording head is driven to eject ink so that ink droplets are impacted onto a recording medium for forming an image by this drive pattern. In FIG. 3(*a*), the "pattern-start" occurs immediately before the print drive pattern and, and the "pattern-end" occurs immediately after the print drive pattern.

FIG. 3(*b*) is an example of a purge drive pattern which is used for restoring nozzles to operating condition when ink has dried on the nozzles exposed to the air for a long time, which drying prevents normal jetting of ink droplets. The purge drive pattern starts and ends at the reference potential for this purge drive pattern respectively indicated by "pattern-start" and "pattern-end" in FIG. 3(*b*). Between the start and the end of the purge drive pattern, the recording head is driven to eject ink so that ink droplets are purged onto the maintenance unit located outside of the recording area.

FIG. 3(*c*) is an example of a minor drive pattern as an operation to prevent ink drying at the nozzles. The minor drive pattern starts and ends at the reference potential for this minor drive pattern respectively indicated by "pattern-start" and "pattern-end" in FIG. 3(*c*). Between the start and the end of the minor drive pattern, the recording head ejects no ink droplet but the actuator is driven to such an extent that the ink will not dry at the nozzles.

An abrupt increase or decrease in the size of the actuator 29 is used to produce a driving force for jetting ink droplets. Effective ink jetting may be performed by pulling in the ink level in the nozzle once before pushing the ink out to jet.

Applying the drive pattern is an operation that starts dropping a potential (electric potential) and turns to raising the potential, and it is effective that individual patterns perform raising and dropping the individual potentials at their specific reference potential. The drive pattern operation is required to preliminarily perform a pull-up operation to the reference potential before driving and perform a pull-down operation to zero after driving. The drive pattern ends at the point (a pattern end) where pull-down operation starts, as shown in FIG. 3.

As the reference potential varies depending on the kind of drive pattern (print driving, purge driving, minor driving), waveform patterns (drive patterns) of pull-up and pull-down vary for the individual drive patterns.

Next, the control method of the drive pattern operation is described by referring to a block diagram.

Figure 4:
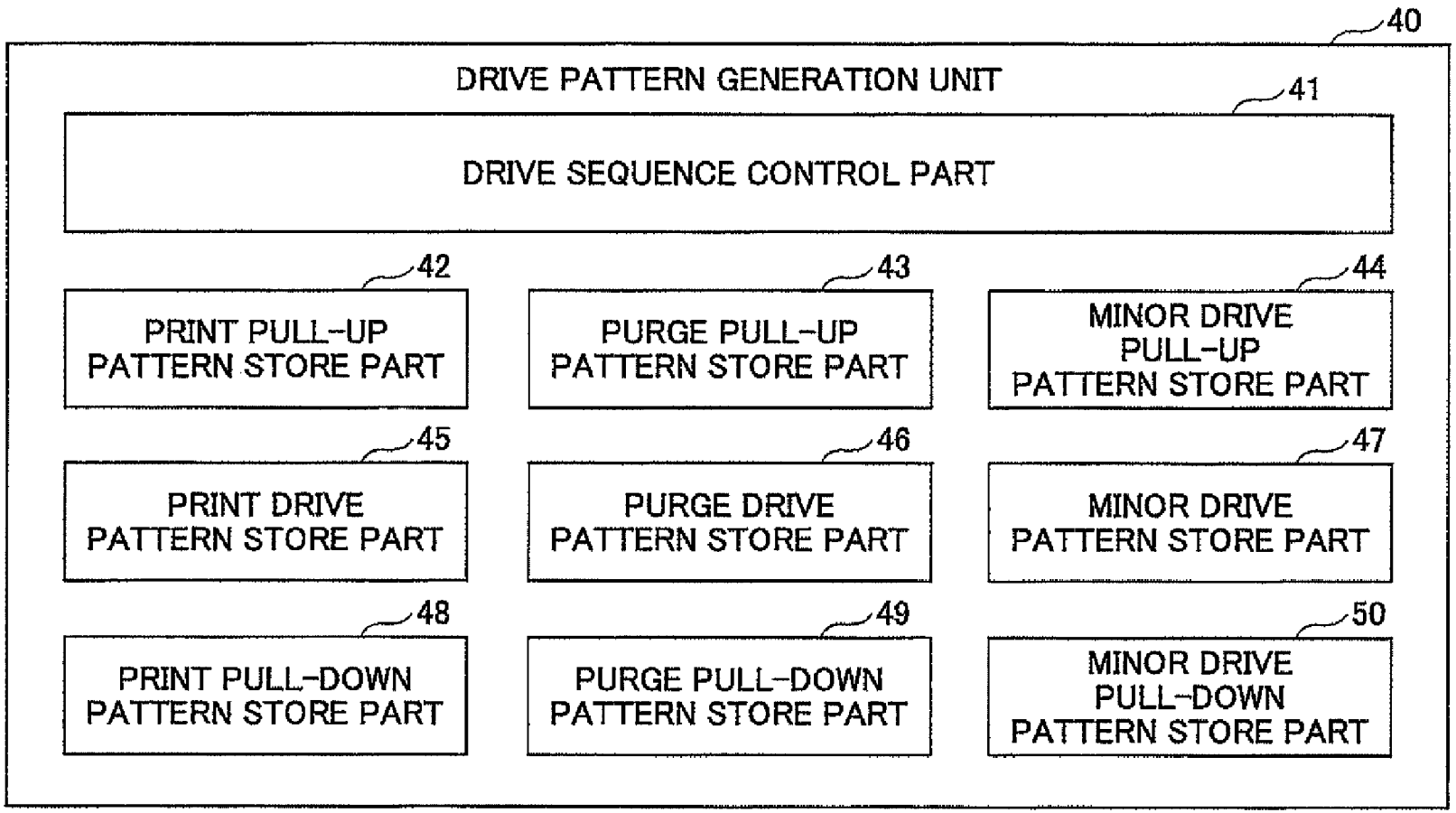
FIG. 4 shows a block diagram of a conventional drive pattern control part.
Figure 5:
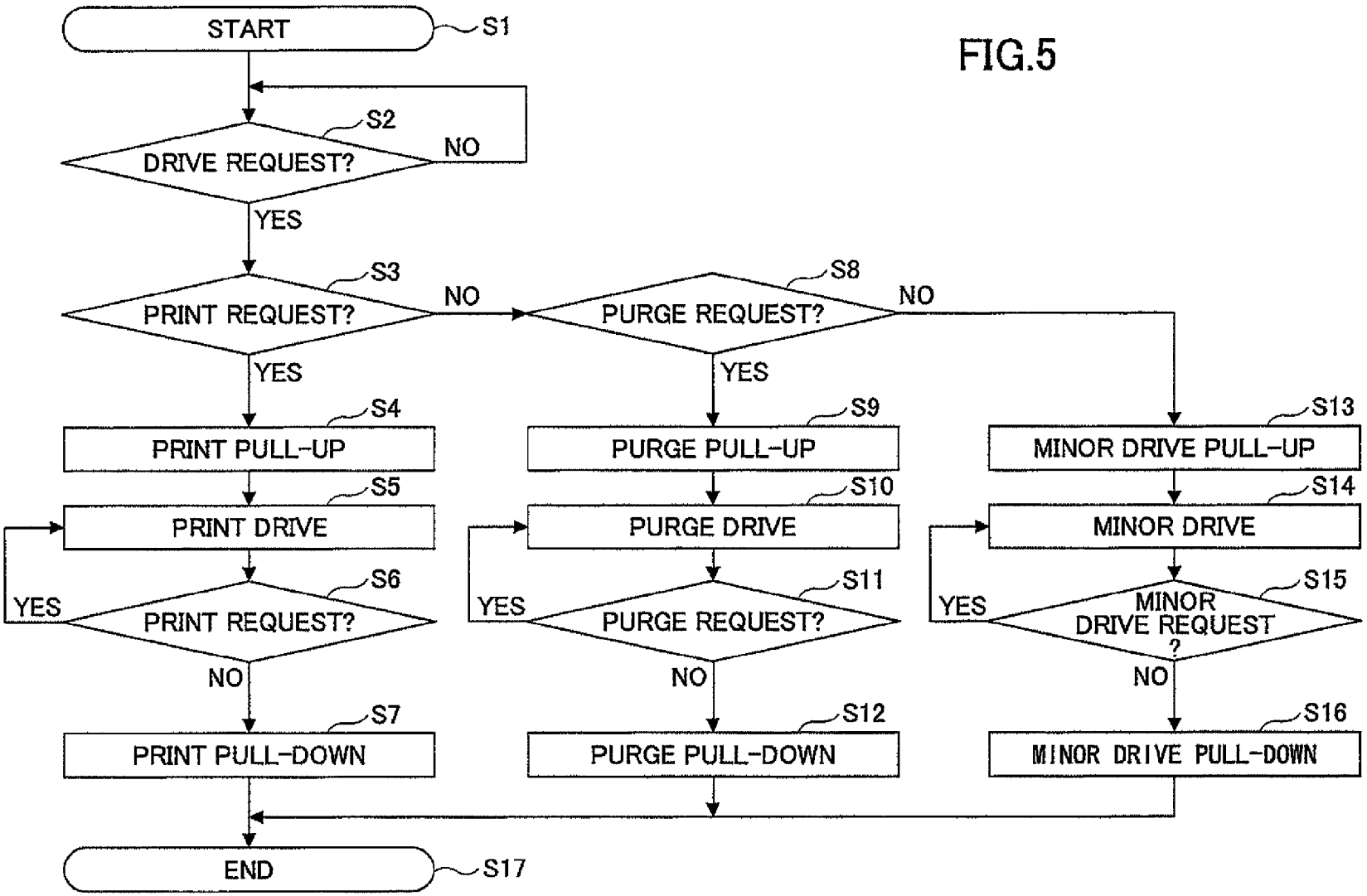
FIG. 5 shows a flowchart of conventional drive pattern control.

To clarify the issue to be solved by an embodiment of the present invention, a conventional configuration of a drive pattern generation unit 40 is described with reference to a block diagram and a control flowchart as shown in FIG. 4 and FIG. 5, respectively.

The drive pattern generation unit 40 of FIG. 4 includes "pattern store parts 42 through 50" to store operational signals for performing pull-up, driving, and pull-down for a print pattern, a purging pattern, and a minor drive pattern, respectively, and these operations are controlled by a drive sequence control part 41.

FIG. 5 shows a control flowchart of the drive pattern operation applied by a conventional drive pattern generation unit 40

When the recording head 9 is requested to perform a driving operation (drive request S2), the drive pattern generation unit 40 confirms the object of the request first. In this example, the priority of the head driving is assumed to be in the order of (a) print driving (print drive) S5, (b) purge driving (purge drive) S10, and (c) minor driving (minor drive) S14. Thus, the drive request S2 is confirmed by this order.

When the print drive is requested S3, a print pull-up S4 is performed first. For a print pull-up operation, the drive pattern generation unit 40 reads data stored in a print pull-up pattern store part 42 of FIG. 4, and outputs the data to perform the pull-up operation for setting a recording head (head) 9 driving potential as a reference potential of the print driving (FIG. 3(*a*)).

Next, print driving S5 is performed. In the print driving S5, the drive pattern generation unit 40 reads data stored in a print drive pattern store part 45 of FIG. 4, and outputs by jetting ink droplets on a recording medium 11. This print driving S5 is repeatedly operated the entire time the print request S3 is maintained.

If there is no print request, a print pull-down S7 is performed. In the print pull-down S7 process, the drive pattern generation unit 40 reads data stored in a print pull-down pattern store part 48, and outputs to set the head driving potential to zero potential by a pull-down operation as shown in FIG. 3(*a*).

When the print pull-down operation is completed, the print operation is completed (S17).

For purge driving and minor driving, their operating sequences are performed similarly to the print driving sequence described above.

Figure 6:
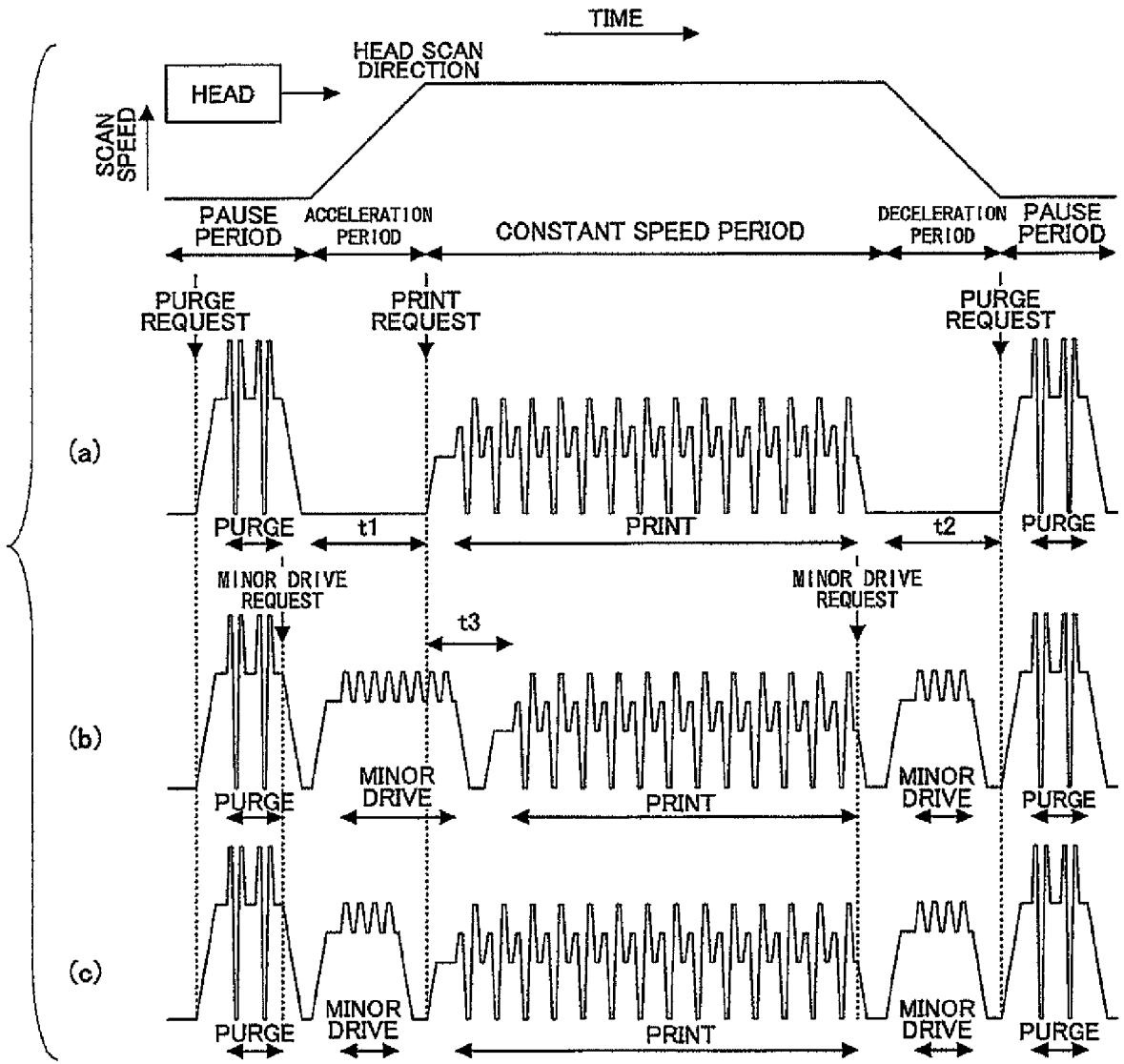
FIG. 6 shows a timing chart for driving a recording head and an output of a drive pattern.

Next, FIG. 6 shows a timing chart indicating the relationship between the scan speed of the recording head 9 and the drive patterns of respective print driving, purge driving, and minor driving described above. The recording head 9 scans from the left to the right in FIG. 6, and after performing purge driving at a halt status, is accelerated. When having reached a constant speed, the recording head 9 starts writing, then upon being decelerated, the recording head 9 performs purge driving again in a halt status.

FIG. 6 shows timing charts of drive patterns (a)-(c). The vertical direction of FIG. 6(*a*)-(*c*) indicates potential and the horizontal direction indicates time.

The timing charts indicate that individual sequences are performed in order of purge driving, print driving, and purge driving.

In the charts, if a recording head drive pattern is being output, that is, if any of the drive patterns, that is, print driving, purge driving, and minor driving, is being output, a potential of the recording head 9 is applied with a pull-down operation once, and applied with a pull-up operation to a requested reference potential of the drive pattern. Thus, the potential of the recording head 9 is set to zero potential independent of a requested driving condition (drive pattern), and the power (energy) consumption becomes large through the pull-up and pull-down operations because the potential difference between the pull-up operation and the pull-down operation is large.

Further, the recording head 9 is in a halt condition during intervals t1 and t2 in chart (a). However, the recording head 9 can be maintained in better condition when a minor driving operation is introduced. Considering the advantage, a minor driving operation is introduced as indicated in chart (b).

However, for chart (b) of FIG. 6, minor driving operations for a better condition are not performed enough because pull-up/pull-down periods are introduced before and after individual driving operations, and the energy consumed by performing pull-up/pull-down operations becomes greater than that in the pattern of chart (a) of FIG. 6.

Further, if sufficient minor driving operations are introduced in chart (b) of FIG. 6, a transit period t3 interrupts a printing time period, so that a print driving operation is delayed, which causes deviations of printing positions.

To avoid such a problem, for the operation performed before print driving indicated in chart (c) of FIG. 6, the number of the minor driving operations needs to be adjusted, which may raise the cost due to the complexity of operations and additional configurations.

The present invention is proposed for reducing issues of the conventional driving operations described above.

More details are described in the following.

Figure 7:
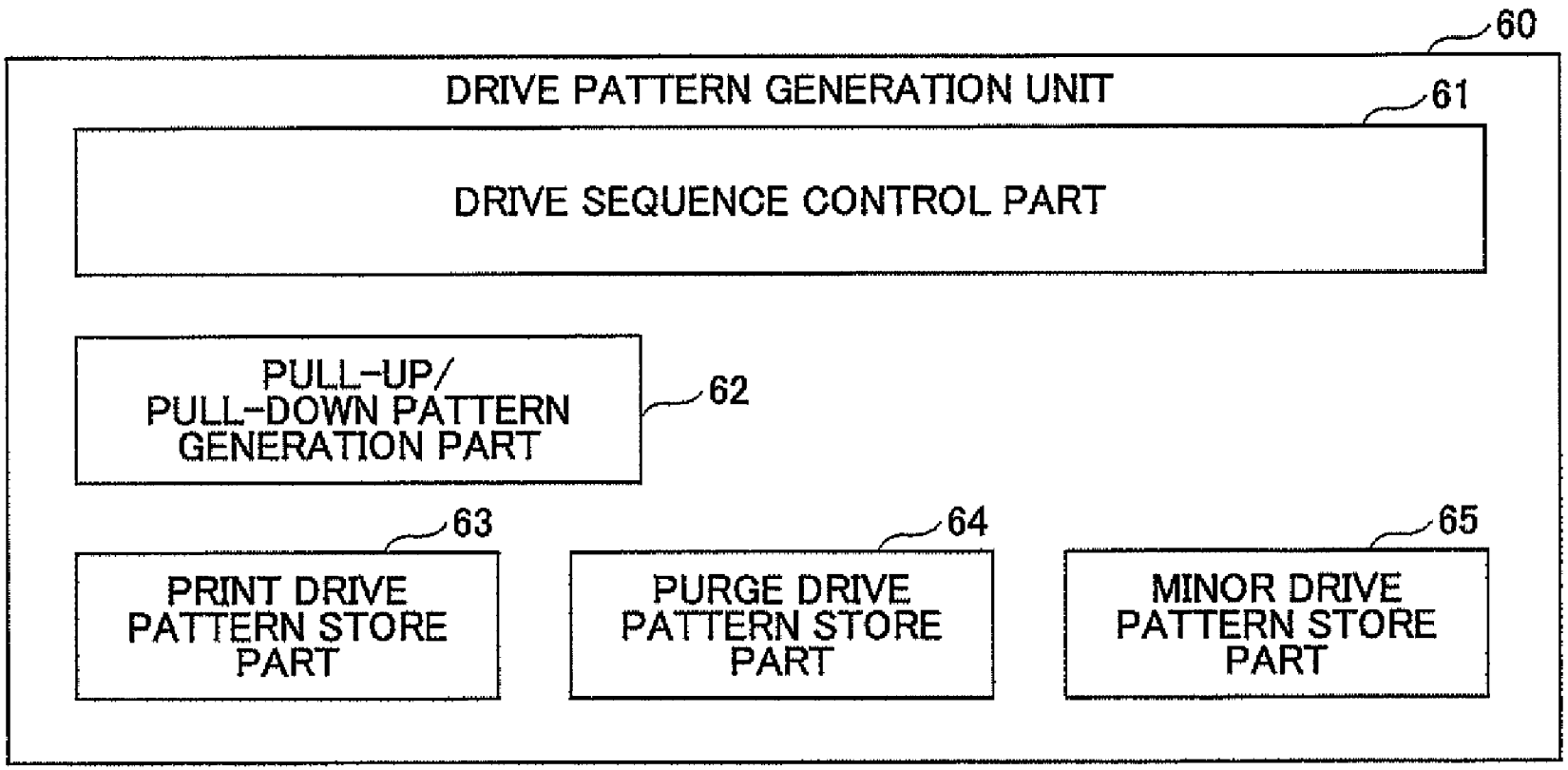
FIG. 7 shows a block diagram of a drive pattern control part used in an image forming apparatus of the present invention.

FIG. 7 shows a block diagram of a drive pattern generation unit 60 which embodies the image process control unit of FIG. 2.

The drive pattern generation unit 60 in FIG. 7 includes "a print drive pattern store part 63, a purge drive pattern store part 64 and a minor drive pattern store part 65" to store operational signals for generating a print drive pattern, a purge drive pattern, and a minor drive pattern, respectively. The individual drive patterns are performed by a "pull-up/pull-down pattern generation part 62" which is controlled by a drive sequence control part 61.

In a configuration of the control part of FIG. 7, drive pattern store parts 48, 49 and 50 of FIG. 4 to store pull-up/pull-down patterns of individual drive patterns are not provided. Instead, a "pull-up/pull-down pattern generation part 62" controls all drive patterns, thereby unifying control. Thus, this configuration may remarkably reduce required memory capacity compared to the conventional case shown in FIG. 4.

Further, the "pull-up/pull-down pattern generation part 62 (pull-up/pull-down part)" is designed to automatically compute a slope by comparing a present potential of a drive pattern and a target reference potential from a predetermined time. The pull-up/pull-down pattern generation part 62 outputs "a pull-up slope", "a pull-down slope", and "a target potential (reference potentials of respective drive patterns, or zero potential)" and automatically generates a transition pattern to transfer a head driving potential to the target reference potential.

The pull-up/pull-down patterns need not be complex, unlike the conventional servo control case, and the drive patterns may have small waveforms that prevent jetting ink droplets. This may be performed by a simple circuit.

As shown in TABLE 1, a set value of a slope and a corresponding through rate are indicated for generating pull-up/pull-down patterns. For example, when a slope between the potential of a drive pattern and a required reference potential at a predetermined time is determined as +1 of TABLE 1, a through rate may be applied with +140 V/μs.

TABLE 1

| SLOPE VALUE | PULL RATE |
|---|---|
| PULL-UP | |
| +1 | +140 V/us |
| +2 | +280 V/us |
| +3 | +420 V/us |
| +4 | +560 V/us |
| PULL-DOWN | |
| −1 | −150 V/us |
| −2 | −300 V/us |
| −3 | −450 V/us |
| −4 | −600 V/us |

Further, the most proper value of a through rate of the pull-up/pull-down output pattern varies according to the characteristics of the recording head applied. Thereby, the slope value of the pull-up/pull-down is determined depending on recording heads and according to other usage conditions.

Figure 8:
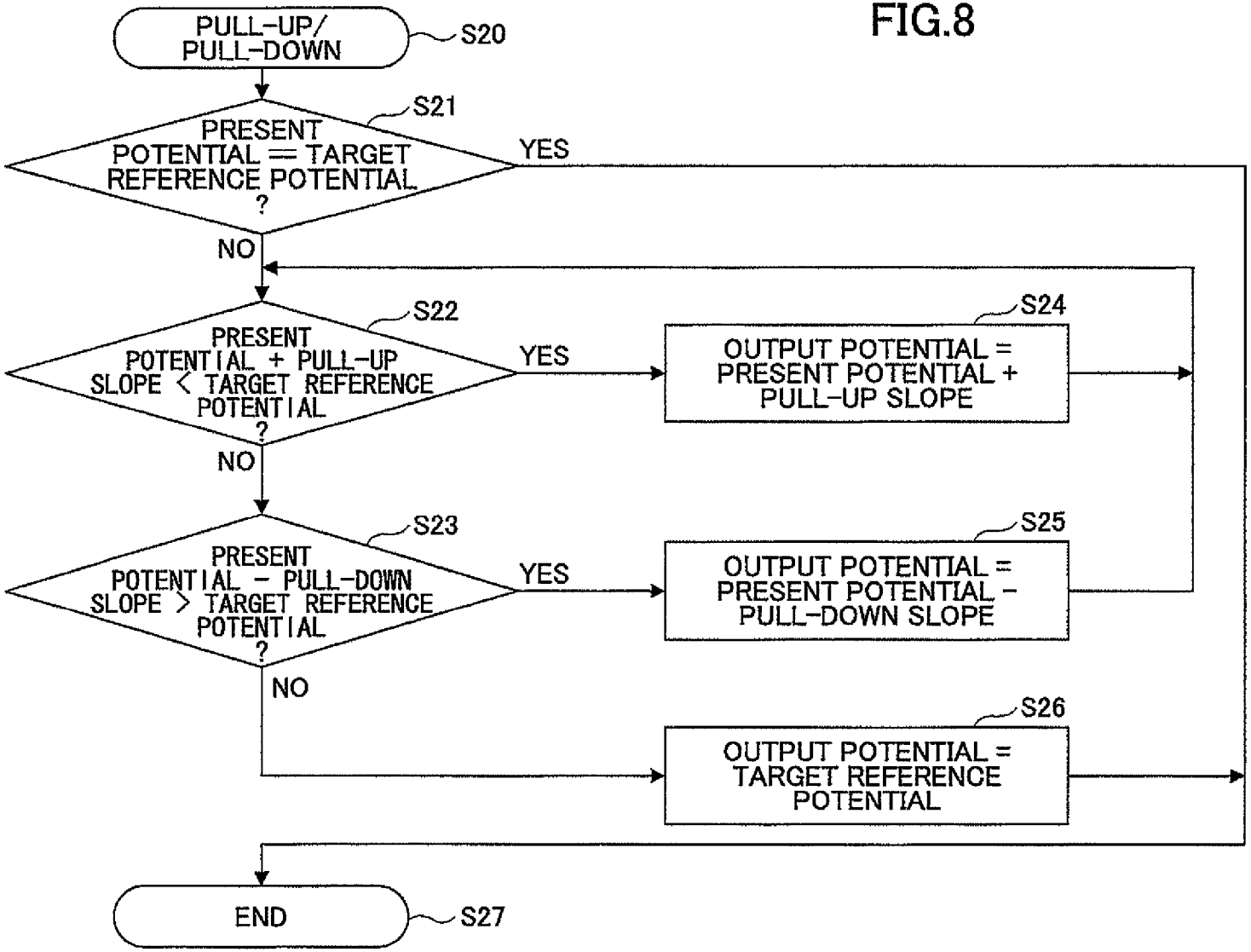
FIG. 8 shows a flowchart of a generating method of a pull-up/pull-down waveform pattern.

FIG. 8 shows a flowchart to describe an automatic generation method of pull-up/pull-down patterns.

It may be regarded that a slope value of pull-up/pull-down patterns and a target reference potential for transferring to a required drive pattern are preliminarily determined.

First, a potential at a predetermined time (a present potential in FIG. 8) is confirmed (S21).

If the present potential matches the target reference potential, pull-up/pull-down pattern generation is avoided and the operation is stopped (S27).

When the present potential does not match the target reference potential, the slope value of pull-up is added (S22) or the slope value of pull-down is subtracted (S23).

If the added slope value is lower than the target reference potential, then the added slope value is set as an output potential (a drive potential of the recording head) (S24).

If a potential value obtained by subtracting a slope value of pull-down from the present potential is higher that the target reference potential (S23), the subtracted slope value is set as an output of the driving potential (S25).

When there is no applicable case, it is determined that the difference between the present potential and the target reference potential is smaller than the slope value of pull-up/pull-down, and the target reference potential is simply set as an output potential (S26), and the operation is completed (S27).

Figure 9:
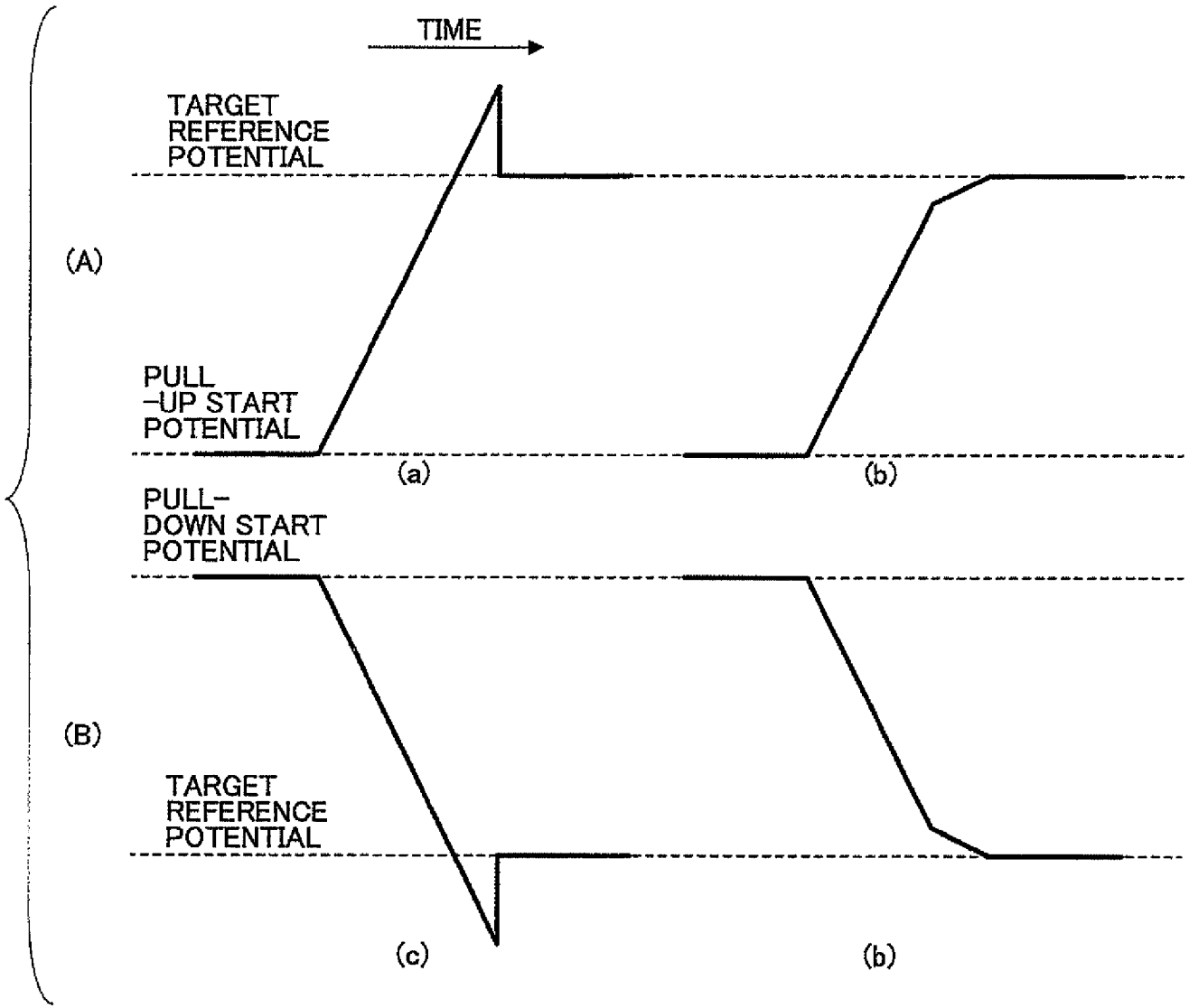
FIG. 9 shows an example of diagrams indicating output potentials of pull-up/pull-down waveform patterns (a), (b), (c) and (d) by automatic generation.

FIG. 9 shows an example of output of pull-up/pull-down patterns that are automatically generated.

A simple addition or subtraction of a driving potential is performed with a slope value to reach a target reference potential from the potential at a predetermined time. When a pull-up/pull-down pattern is generated, the generated potential may become larger than the target reference potential, as shown in FIG. 9(*a*) or FIG. 9(*c*). If the potential exceeds the target reference potential, this may cause unusual operations of an inkjet recording apparatus; for example, the recording head may perform unnecessary operations of ink jetting.

To avoid such inconvenience, according to the flowchart in FIG. 8, the driving potential is confirmed when the potential obtained (a potential being output) by adding or subtracting a slope value approaches the target reference potential. As described above, it may be determined whether a value obtained by adding or subtracting a slope value is set as an output potential (FIG. 9(*b*), (*d*)) or the target reference potential is simply set as an output potential (FIG. 9(*a*), (*c*)). Thereby, the drive pattern may be optimized.

As an embodiment of the image forming apparatus of the present invention, a print operation using the inkjet printer is described.

First Embodiments

Figure 10:
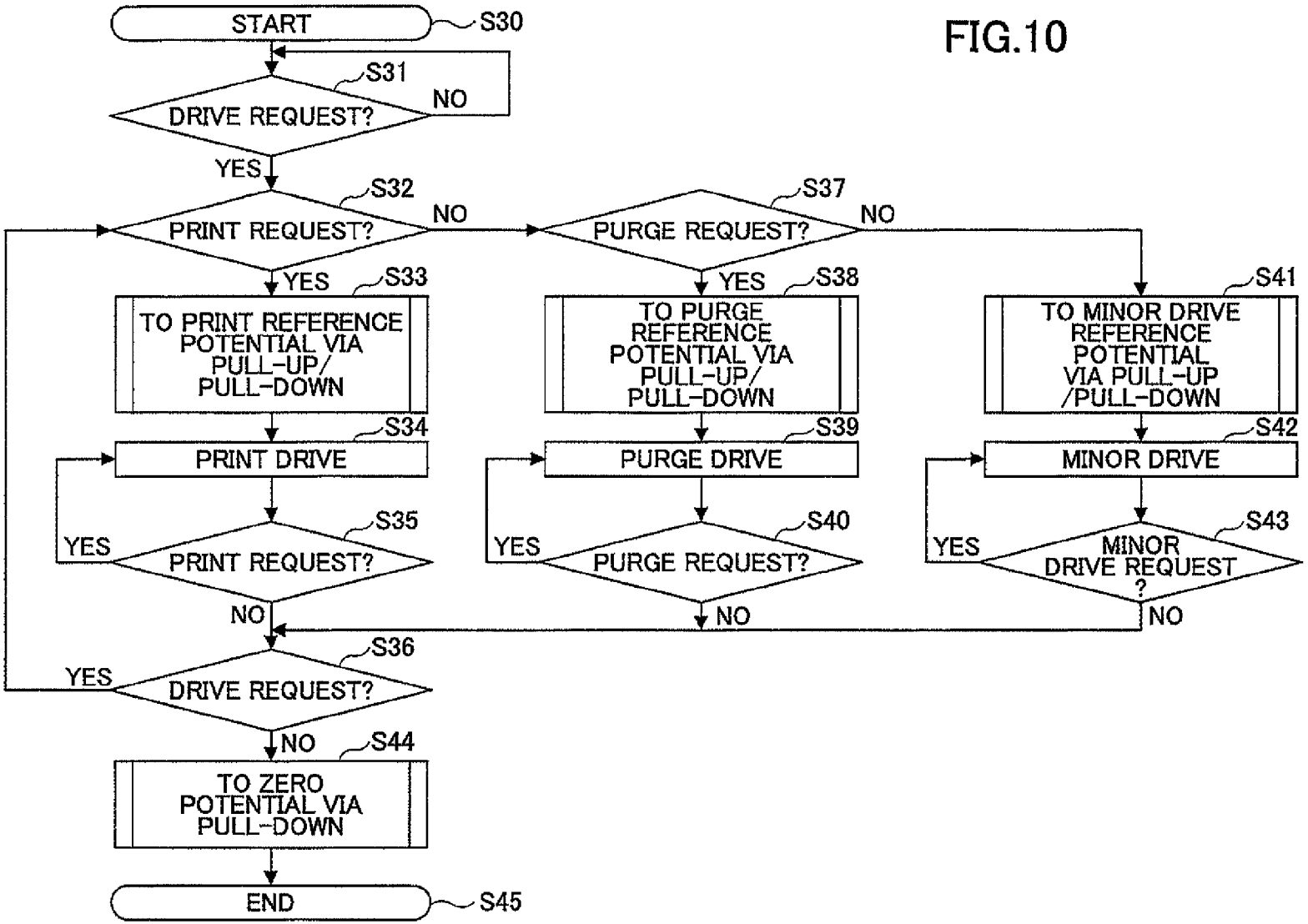
FIG. 10 shows a flowchart of drive pattern control of embodiment 1.

FIG. 10 shows a flowchart for describing drive pattern control in printing operations using an inkjet printer according to an embodiment of the present invention.

In the present example, unlike the flowchart of conventional drive pattern control shown in FIG. 5, for each driving (print drive, purge drive, minor drive), the drive pattern generation unit 60 does not complete a pull-down operation to zero potential (electric potential) after individual operations are completed and then confirm if there is another driving request (S36).

When one driving is completed and a predetermined drive request is confirmed (S36), addition or subtraction of a slope value to or from the potential (S33, S38 or S41) at that time to become a target reference potential for the next predetermined driving is performed and predetermined head driving (S34, S39 or S42) is continuously performed.

When there is no driving request, the drive pattern generation part 60 returns the driving potential to zero potential by a pull-down operation (S44) and the head driving is completed (S45).

Next, more specifically, a drive pattern output according to the present embodiment is described.

Figure 11:
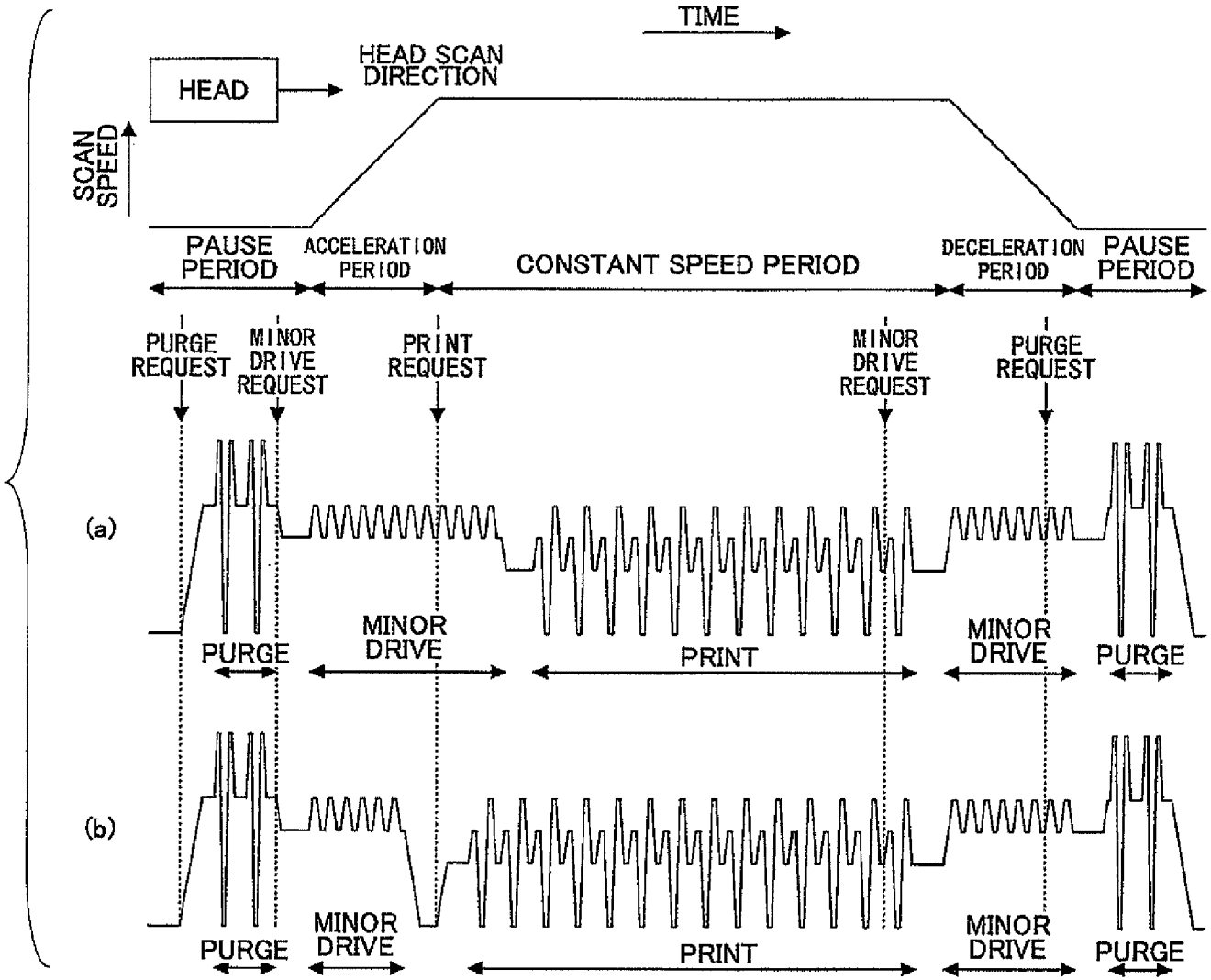
FIG. 11 shows a timing chart for driving a recording head and an output of a drive pattern.

FIG. 11 shows the relationship between the scan speed of the inkjet head and the drive patterns performed by output pattern control for print driving, purge driving, and minor driving described above. The vertical direction for FIG. 11(*a*) and FIG. 11(*b*) indicates potential (voltage), and the horizontal direction indicates time.

The recording head is assumed to scan from the left to the right in FIG. 11, performs purge driving at a halt condition, and starts printing when reaching a constant speed after being accelerated. After being decelerated, the recording head performs purge driving again at a halt condition.

FIG. 11(*a*) and FIG. 11(*b*) indicate examples of timing charts for drive patterns.

When comparing the chart of FIG. 11(*a*) and the chart of FIG. 6(*b*) indicating an example of a conventional drive pattern, the chart FIG. 11(*a*) shows no drop to zero potential for each driving part. The drive pattern of the recording head is optimized so that a potential of the recording head at a certain time is changed to a target reference potential by pull-up/pull-down operations, and then the minor driving period is maintained for a sufficient period unlike the conventional art.

Further, power consumption caused by pull-up/pull-down operations is reduced and it is observed that a less-undulating drive pattern is obtained.

However, for the drive pattern of FIG. 11(*a*) as well as the case of FIG. 6(*b*), a lot of minor driving operations are inserted, which delay switching to print driving, which may cause deviations of printing positions.

To avoid such a problem, as shown in FIG. 11(B), it is preferable that the number of the minor driving operations be adjusted to operate pull-down once to set zero potential, then the potential is raised again to a reference potential by a pull-up operation for print driving.

Second Embodiment

Figure 12:
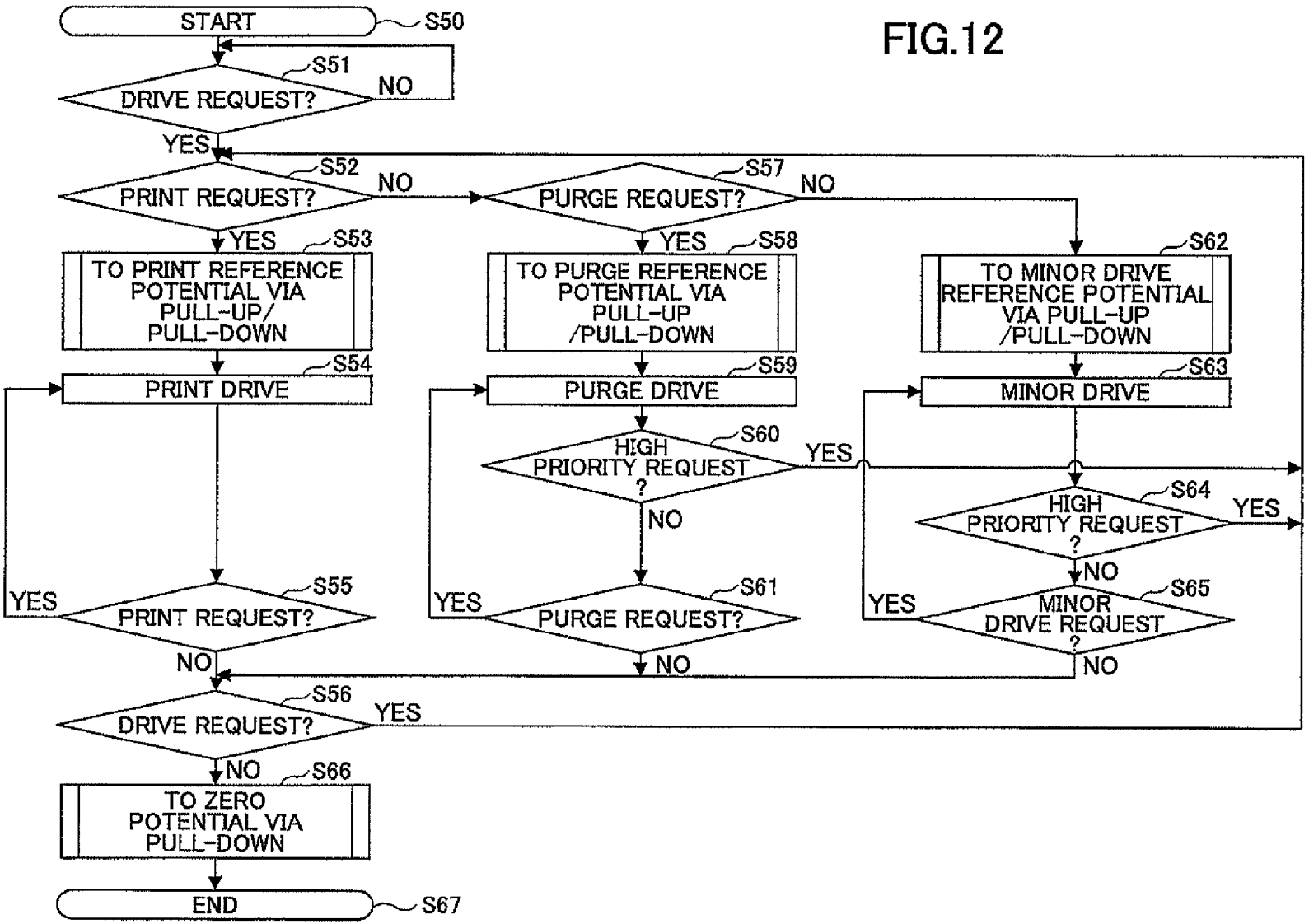
FIG. 12 shows a flowchart of drive pattern control of the second embodiment.

FIG. 12 shows a flowchart describing a drive pattern control of a print operation using an inkjet printer of an embodiment of the present invention.

In the present embodiment, unlike the first embodiment shown in FIG. 10, the drive pattern generation unit 60 confirms whether there is another high priority drive request for purge driving and minor driving (S60 and S64 respectively) after one driving operation is completed.

For example, after one purge driving operation is performed (S59), if there is a high priority request (YES at S60), the purge driving is interrupted and the drive pattern generation unit 60 confirms the kind of the request (kind of the drive pattern). For minor driving, a similar operation is performed.

Further, the driving priority is determined in order of print driving, purge driving, and minor driving. Thus, a confirmation of the high priority request after a purge driving operation is determined if there is a print driving request. A confirmation of a high priority request after a minor driving operation is determined if there is a print driving request first and then a purge driving request by an output pattern confirmation unit. Namely, the output pattern confirmation unit confirms presence or absence of a drive request according to a predetermined priority order for the plural drive patterns.

Next, a specific drive pattern of the second embodiment is described.

Figure 13:
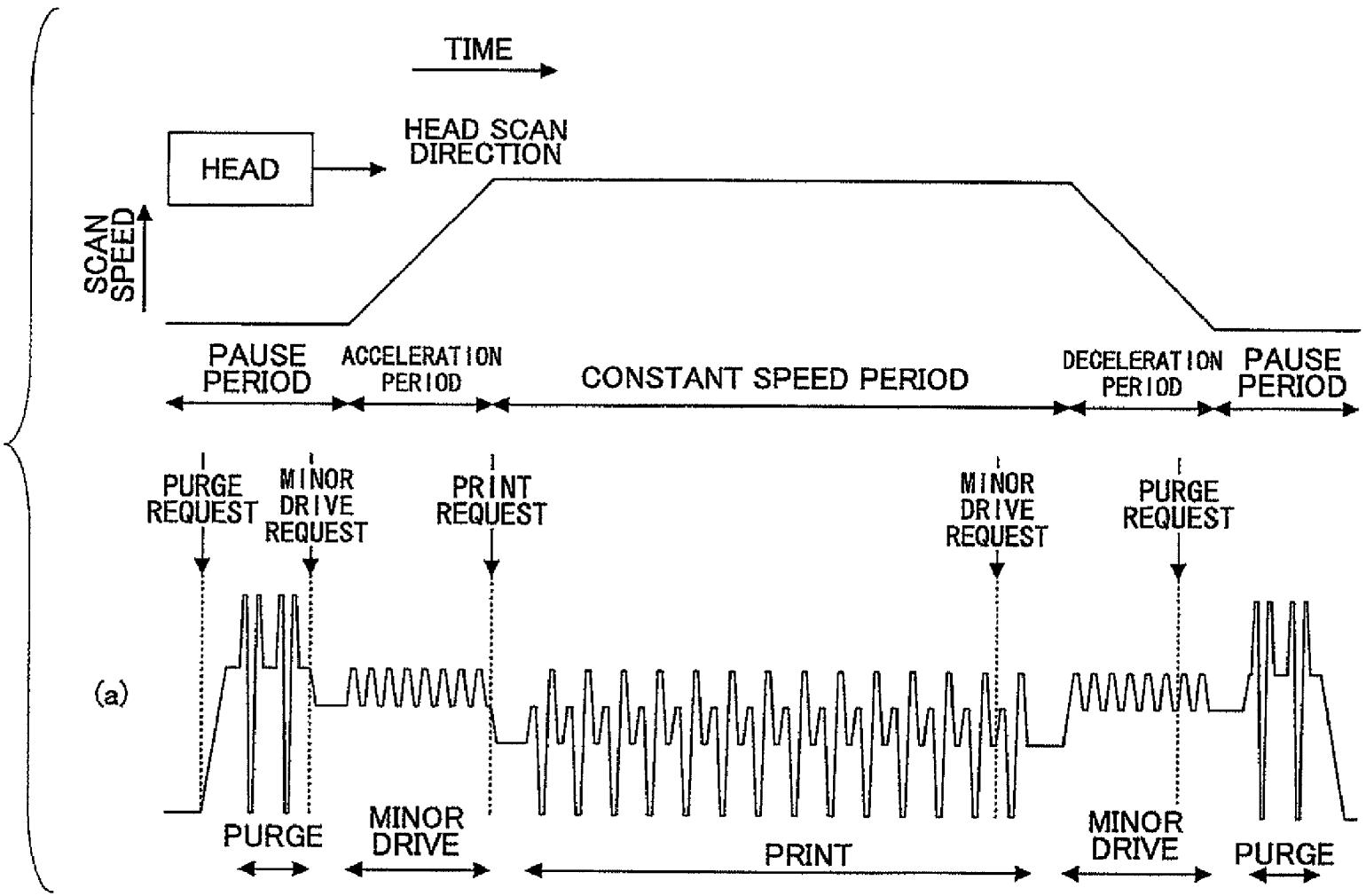
FIG. 13 is a timing chart for driving a recording head and an output of a drive pattern.

FIG. 13 shows the relationship between the recording head scan speed and drive patterns performed by output pattern control for the print driving, the purge driving, and the minor driving described above. The vertical direction of FIG. 13(*a*) indicates the potential and the horizontal direction indicates time.

The recording head is assumed to scan from the left to the right in FIG. 13. After a purge driving operation at a halt condition, the recording head is accelerated and reaches a constant speed, then starts printing. After deceleration, the recording head performs a purge driving operation again at a halt condition.

FIG. 13(*a*) shows a timing chart of an example of a drive pattern.

For the present embodiment, when a high priority driving request is made while predetermined driving is being performed, the predetermined driving at that time is interrupted and the requested driving is started, so that no adjustment of the number of minor driving operations is necessary.

Thereby, the control of inserting minor driving operations to be performed before print driving operations is simplified compared to FIG. 11(*a*), and there is an advantage for further reduction of power consumption caused by pull-up/pull-down operations.

Further, executable instructions of sequences described above may be recorded on a computer-readable recording medium, for example onto the RON 21. The computer may execute the executable instructions and perform the operations described above. In this case, the computer performs at least the steps of processing an input image to generate a control signal; generating at least a first drive pattern and a second drive pattern which is different from the first drive pattern to drive a recording head in response to the control signal; setting a reference potential of the second drive pattern as a target reference potential; and performing pull-up or pull-down operation from a potential at a predetermined time after a pattern end of the first drive pattern to pull up or pull down the potential to the target reference potential according to a slope value; wherein the slope value is determined by comparing the potential and the target reference potential.

The present invention is not limited to the specifically disclosed embodiments, and variations and modifications may be made without departing from the scope of the present invention.

The present application is based on and claims the benefit of a Japanese Patent Application No. 2007-196253, filed on Jul. 27, 2007, the disclosure of which is hereby incorporated by reference.

What is claimed is:

1. An image forming apparatus comprising:

an image process control unit configured to process an image data and to generate a control signal; and a drive pattern generation unit configured to generate a drive pattern to drive a recording head, based on the control signal;

the drive pattern generation unit generating at least a first drive pattern and a second drive pattern which is different from the first drive pattern;

the drive pattern generation unit setting a reference potential of the second drive pattern as a target reference potential and applying a pattern end of the first drive pattern to one of a pull-up pattern and a pull-down pattern operation before the second drive pattern is performed, wherein the drive pattern generation unit generates one of the pull-up pattern and the pull-down pattern based on a slope value obtained by comparing the target reference potential and a potential at the pattern end.

2. The image forming apparatus as claimed in claim 1, wherein the drive pattern generation unit modifies an output potential of a drive pattern to set a target reference potential of a second drive pattern when the output potential of the drive pattern exceeds the target reference potential of the second drive pattern while a pull-up operation of the drive pattern generation unit is being performed.

3. The image forming apparatus as claimed in claim 1, wherein the drive pattern generation unit sets an output potential of a drive pattern to a target reference potential of a second drive pattern when the output potential of the drive pattern is below the target reference potential of the second drive pattern after the pull-down operation is performed by the drive pattern generation unit.

4. The image forming apparatus as claimed in claim 1, wherein the drive pattern generation unit determines one of slope values of the pull-up pattern and the pull-down pattern to be applied to the drive pattern according to a driving environment of the recording head.

5. The image forming apparatus as claimed in claim 1, further comprising:

an output pattern confirmation unit that confirms presence or absence of a drive request according to a predetermined priority order for the plural drive patterns.

6. The image forming apparatus as claimed in claim 5, wherein the drive pattern generation unit prevents a potential of a drive pattern from being set to zero potential and sets a first drive pattern output potential as a reference potential, and sets a second drive pattern output potential as a target reference potential to obtain a slope value for generating one of a pull-up pattern and a pull-down pattern after performing the first drive pattern according to a predetermined priority order and before outputting the second drive pattern.

7. The image forming apparatus as claimed in claim 5, wherein the output pattern confirmation unit confirms the presence or absence of the drive request of the second drive pattern and determines the priority order of the drive patterns for the plural drive patterns, and if the priority of the second drive pattern is higher than the priority of the first drive patterns the drive pattern generation unit interrupts the output for the first drive pattern and switches to the second drive pattern, and generates one of the pull-up pattern and pull-down pattern after outputting the first drive pattern for a predetermined number of times.

8. An image forming method comprising the steps of:

(a) processing an input image to generate a control signal;

(b) generating at least a first drive pattern and a second drive pattern which is different from the first drive pattern to drive a recording head in response to the control signal;

(c) setting a reference potential of the second drive pattern as a target reference potential; and (d) performing pull-up or pull-down operation from a potential at a predetermined time after a pattern end of the first drive pattern to pull up or pull down the potential to the target reference potential according to a slope value;

wherein the slope value is determined by comparing the potential and the target reference potential.

9. The image forming method as claimed in claim 8, wherein the step (c) sets an output potential of a drive pattern to the target reference potential of a second drive pattern when the output potential of the drive pattern is below the target reference potential of the second drive pattern after the pull-down operation is performed.

10. The image forming method as claimed in claim 8, wherein one of slope values of the pull-up pattern and the pull-down pattern to be applied to the drive pattern is determined according to a driving environment of the recording head.

11. A computer-readable recording medium having executable instructions therein which, when executed by a computer, performs the steps of:

(a) processing an input image to generate a control signal;

(b) generating at least a first drive pattern and a second drive pattern which is different from the first drive pattern to drive a recording head in response to the control signal;

(c) setting a reference potential of the second drive pattern as a target reference potential; and (d) performing pull-up or pull-down operation from a potential at a predetermined time after a pattern end of the first drive pattern to pull up or pull down the potential to the target reference potential according to a slope value;

wherein the slope value is determined by comparing the potential and the target reference potential.

* * * * *